US007884020B2

(12) United States Patent
Hirabayashi et al.

(10) Patent No.: US 7,884,020 B2
(45) Date of Patent: Feb. 8, 2011

(54) POLISHING CLOTH AND METHOD OF MANUFACTURING SEMICONDUCTOR DEVICE

(75) Inventors: Hideaki Hirabayashi, Yokohama (JP); Naoaki Sakurai, Yokohama (JP); Akiko Saito, Yokohama (JP); Koji Sato, Chita-gun (JP); Tomiho Yamada, Ohbu (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 802 days.

(21) Appl. No.: 11/863,788

(22) Filed: Sep. 28, 2007

(65) Prior Publication Data

US 2008/0032504 A1 Feb. 7, 2008

Related U.S. Application Data

(62) Division of application No. 10/994,229, filed on Nov. 23, 2004, now Pat. No. 7,291,188.

(30) Foreign Application Priority Data

Nov. 28, 2003 (JP) ..... 2003-400915

(51) Int. Cl.
*H01L 21/302* (2006.01)

(52) U.S. Cl. ..... 438/689; 438/692; 216/88; 51/298; 51/299; 51/307; 451/526

(58) Field of Classification Search ..... 438/689, 438/692; 216/88; 51/298, 299, 307; 451/526
See application file for complete search history.

(56) References Cited

U.S. PATENT DOCUMENTS

| | | | |
|---|---|---|---|
| 4,138,228 | A | 2/1979 | Hartfelt et al. |
| 5,942,570 | A | 8/1999 | Matsukura et al. |
| 6,616,520 | B1 | 9/2003 | Kawahara et al. |
| 7,001,252 | B2 | 2/2006 | Hasegawa et al. |
| 2002/0042200 | A1 | 4/2002 | Fawcett |
| 2003/0199230 | A1 | 10/2003 | Hirabayashi et al. |

FOREIGN PATENT DOCUMENTS

| | | |
|---|---|---|
| EP | 1 295 682 A1 | 3/2003 |
| JP | 2001-179607 | 7/2001 |
| JP | 2001-291685 | 10/2001 |
| JP | 2002-190460 | 7/2002 |
| WO | WO 02-28598 A1 | 4/2002 |

*Primary Examiner*—Nadine G Norton
*Assistant Examiner*—Mahmoud Dahimene
(74) *Attorney, Agent, or Firm*—Oblon, Spivak, McClelland, Maier & Neustadt, L.L.P.

(57) ABSTRACT

A polishing cloth used in the chemical mechanical polishing treatment comprises a molded body of (meth)acrylic copolymer having an acid value of 10 to 100 mg KOH/g and a hydroxyl group value of 50 to 150 mg KOH/g.

23 Claims, 6 Drawing Sheets

POLISHING CLOTH AND METHOD OF MANUFACTURING SEMICONDUCTOR DEVICE

This is a divisional application of U.S. application Ser. No. 10/994,229, filed Nov. 23, 2004, now U.S. Pat. No. 7,291,188.

CROSS-REFERENCE TO RELATED APPLICATIONS

This application is based upon and claims the benefit of priority from prior Japanese Patent Application No. 2003-400915, filed Nov. 28, 2003, the entire contents of which are incorporated herein by reference.

BACKGROUND OF THE INVENTION

1. Field of the Invention

The present invention relates to a polishing cloth and a method of manufacturing a semiconductor device.

2. Description of the Related Art

It is known in the art that a polishing cloth is used in the manufacturing process of a semiconductor device in the cases where a semiconductor substrate, e.g., a semiconductor wafer, is mirror-finished by the chemical mechanical polishing treatment, where an insulating film is etched back for forming a buried insulating film in the semiconductor wafer (i.e., a buried element isolating region), and where a metal film is etched back for forming a buried wiring.

The polishing cloth known in the art is constructed to comprise a base body consisting of a hard polyurethane foam or a two-layer structure consisting of a hard polyurethane foam and a polyurethane unwoven fabric, and a surface layer of the base body having fine irregularities. The polishing cloth of the particular construction is used for polishing an insulating film deposited on the surface of a semiconductor wafer having, for example, a trench formed therein so as to form a buried insulating film (i.e., an element isolating region). To be more specific, the semiconductor wafer is held by a holder such that an insulating film, which is to be polished and formed on the semiconductor wafer, is allowed to face the polishing cloth. The semiconductor wafer having the insulating film formed thereon is pushed by the holder toward the polishing cloth under a desired load, and the holder and the polishing cloth are rotated in the same direction while supplying a polishing slurry containing abrasive grains from a supply pipe onto the polishing cloth so as to polish the insulating film formed on the semiconductor wafer.

In the polishing treatment described above, the abrasive grains contained in the polishing slurry and having a diameter of, for example, about 0.2 μm are loaded in the open cells, which generally have a diameter of 40 to 50 μm, of the polishing cloth so as to be dispersed uniformly between the polishing cloth and the insulating film formed on the semiconductor wafer. The abrasive grains are also held in the polishing cloth portion between the adjacent open cells of the polishing cloth. It follows that the insulating film formed on the semiconductor wafer is mechanically polished.

However, during the polishing treatment for a long time, the abrasive grains are accumulated in the open cells so as to increase the amount of the abrasive grains present in the polishing cloth portion between the adjacent open cells of the polishing cloth. In other words, the polishing force produced by the abrasive grains is increased. As a result, the polishing performance fluctuates such that the polishing rate is increased with time, compared with the polishing rate in the initial polishing stage.

It was customary in the past for the polishing cloth in which the polishing performance fluctuated as described above to be processed with a dressing apparatus for regeneration of the polishing cloth. The dressing apparatus noted above comprises a dressing tool of a construction wherein a large number of diamond particles are attached to a metallic base body by means of electrodeposition. However, it is necessary to apply the dressing treatment noted above every time the target object to be polished is subjected to a polishing treatment and, thus, the polishing operation is rendered troublesome. Also, it is possible for the surface of the target object to be polished to be scratched in the polishing stage by the diamond particles dropping from the dressing tool during the treatment with the dressing apparatus.

On the other hand, a polishing pad that makes it possible to obtain satisfactory polishing characteristics without employing a dressing treatment is disclosed in Japanese Patent Disclosure (Kokai) No. 2001-179607. The polishing pad disclosed in this patent document is formed of a resin, in which the amount of change in the center line average roughness, i.e., the Ra value, after the polishing of a single silicon wafer having an oxide film formed thereon is not larger than 0.2 μm based on the surface irregularity profile formed by the dressing treatment before the polishing stage. For example, the polishing pad noted above is formed of a resin prepared by dispersing polyvinyl pyrrolidone in a liquid phenolic resin or polymethyl methacrylate.

However, the patent document noted above does not refer to the specific materials in conjunction with the control of the Ra value of the polishing pad. In addition, the polishing pad disclosed in this patent document gives rise to the problem that the polishing rate is lowered.

In contrast, a polishing pad excellent in polishing characteristics such that damage such as scratches is not generated in the oxide film that is to be polished is disclosed in Japanese Patent Disclosure No. 2001-291685. The polishing pad disclosed in this patent document is prepared by dispersing fine elements having a high molecular weight such as rubber in an acrylic resin such as an acrylic copolymer.

However, open cells are present on the surface of the polishing pad disclosed in the patent document noted above, with the result that abrasive grains are accumulated in the open cells during the polishing treatment for a long time, giving rise to the problem that the polishing performance fluctuates.

Further, a polishing cloth capable of exhibiting stable polishing performance over a relatively long time without employing a dressing treatment is disclosed in Japanese Patent Disclosure No. 2002-190460. The polishing cloth disclosed in this patent document includes a polishing layer containing a high molecular weight material such as a silyl ester or a vinyl ether adduct of a carboxylic acid.

BRIEF SUMMARY OF THE INVENTION

An aspect of the present invention is to provide a polishing cloth capable of exhibiting stable polishing performance for a long time and capable of improving the polishing rate without employing a dressing treatment.

Another aspect of the present invention is to provide a method of manufacturing a semiconductor device which permits stably forming an element isolating region with high accuracy, the element isolating region consisting of an insulating film buried in a trench formed in a semiconductor substrate.

Another aspect of the present invention is to provide a method of manufacturing a semiconductor device which permits stably forming an interlayer insulating film having a flattened surface on a semiconductor substrate.

Further, still another aspect of the present invention is to provide a method of manufacturing a semiconductor device which permits stably forming a conductive member such as a buried wiring layer with high accuracy in at least one burying material selected from the group consisting of a trench and an aperture portion of an insulating film formed on a semiconductor substrate.

According to an aspect of the present invention, there is provided a polishing cloth used for a chemical mechanical polishing treatment, which comprises a molded body of a (meth)acrylic copolymer having an acid value of 10 to 100 mg KOH/g and a hydroxyl group value of 50 to 150 mg KOH/g.

According to another aspect of the present invention, there is provided a method of manufacturing a semiconductor device, comprising:

forming a trench on a semiconductor substrate;

forming an insulating film on the semiconductor substrate having the trench formed thereon; and forming a buried element isolating region by supplying a polishing slurry containing abrasive grains onto the surface of a polishing cloth which comprises a molded body of a (meth) acrylic copolymer having an acid value of 10 to 100 mg KOH/g and a hydroxyl group value of 50 to 150 mg KOH/g, while rotating the semiconductor substrate under the state that the insulating film formed on the semiconductor substrate is allowed to abut against the polishing cloth, thereby polishing the upper portion of the insulating film such that the lower portion of the insulating film is left unremoved inside the trench, the unremoved lower portion of the insulating film forming the buried element isolating region.

According to another aspect of the present invention, there is provided a method of manufacturing a semiconductor device, comprising:

forming an interlayer insulating film on an irregular pattern on a semiconductor substrate; and supplying a polishing slurry containing abrasive grains onto the surface of a polishing cloth which comprises a molded body of a (meth)acrylic copolymer having an acid value of 10 to 100 mg KOH/g and a hydroxyl group value of 50 to 150 mg KOH/g, while allowing the interlayer insulating film formed on the semiconductor substrate to abut against the polishing cloth, thereby polishing the interlayer insulating film.

Further, according to still another aspect of the present invention, there is provided a method of manufacturing a semiconductor device, comprising:

forming an insulating film on a semiconductor substrate;

forming at least one burying member selected from the group consisting of a trench corresponding to the shape of a wiring layer and an aperture portion corresponding to the shape of a via fill in the insulating film;

forming a conductive material film on the insulating film including the inner surface of the burying member; and supplying a polishing slurry containing abrasive grains onto the surface of a polishing cloth which comprises a molded body of a (meth)acrylic copolymer having an acid value of 10 to 100 mg KOH/g and a hydroxyl group value of 50 to 150 mg KOH/g, while rotating the semiconductor substrate under the state that the conductive material film is allowed to abut against the polishing cloth so as to polish the upper portion of the conductive material film such that the lower portion of the conductive material film is left unremoved inside the burying member, thereby forming at least one conductive member selected from the group consisting of a wiring layer and a via fill.

DETAILED DESCRIPTION OF THE INVENTION

Figure 1:
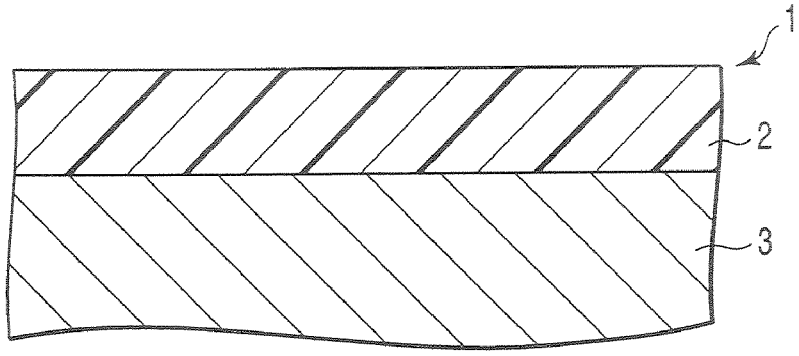
FIG. 1 is a cross-sectional view schematically showing the construction of a polishing cloth according to one embodiment of the present invention.

Some embodiments of the present invention will now be described in detail.

First Embodiment

A first embodiment is directed to a polishing cloth used for the chemical mechanical polishing treatment. The polishing cloth comprises a molded body of a (meth)acrylic copolymer having an acid value of 10 to 100 mg KOH/g and a hydroxyl group value of 50 to 150 mg KOH/g.

The acid value and the hydroxyl group value noted above are measured by the method stipulated in JIS K0070.

Also, the expression (meth)acrylic copolymer given above implies an acrylic and/or methacrylic copolymer.

In the (meth)acrylic copolymer noted above, the acid value relates to the swelling properties when the (meth)acrylic copolymer is brought into contact with a polishing slurry containing abrasive grains, and the hydroxyl group value relates to the wettability of the polishing slurry relative to water. Where the acid value and the hydroxyl group value of the (meth)acrylic copolymer are set to fall within the ranges given above, the polishing cloth receives a frictional force in the presence of the polishing slurry containing the abrasive grains so as to exhibit an appropriate self-collapsing properties because of the balance between the acid value and the hydroxyl group value. As a result, it is possible to stabilize and improve the polishing rate.

Particularly, if the acid value is smaller than 10 mg KOH/g, the swelling properties on the surface of the polishing cloth are rendered low in the presence of the polishing slurry, resulting in failure to obtain an appropriate self-collapsing properties. It follows that it is possible for the stability of the polishing rate to be lowered. On the other hand, if the acid value exceeds 100 mg KOH/g, the swelling properties on the surface of the polishing cloth are rendered excessively high in the presence of the polishing slurry. As a result, the hardness on the surface of the polishing cloth is lowered. It follows that the initial polishing rate tends to be lowered. Also, since the self-collapsing properties are excessively high, it is possible for the stability of the polishing rate to be lowered.

The (meth)acrylic copolymer can be obtained by the copolymerization of a carboxyl group-containing α,β-unsaturated monomer and a hydroxyl group-containing α,β-unsaturated monomer with another α,β-unsaturated monomer. The carboxyl group-containing α,β-unsaturated monomer used for the copolymerization includes, for example, acrylic acid, methacrylic acid, itaconic acid, mesaconic acid, citraconic acid, maleic acid, and fumaric acid. It is desirable to use acrylic acid or methacrylic acid, particularly, methacrylic acid as the carboxyl group-containing α,β-unsaturated monomer. On the other hand, the hydroxyl group-containing α,β-unsaturated monomer used for the copolymerization noted above includes, for example, 2-hydroxyethyl acrylate, hydroxypropyl acrylate, hydroxybutyl acrylate, acrylic acid polyalkylene glycol ester, 2-hydroxyethyl methacrylate, hydroxypropyl methacrylate, hydroxybutyl methacrylate, and methacrylic acid polyalkylene glycol ester. It is desirable to use 2-hydroxyethyl acrylate, hydroxypropyl acrylate, hydroxybutyl acrylate, 2-hydroxyethyl methacrylate, hydroxypropyl methacrylate, and hydroxybutyl methacrylate, particularly, 2-hydroxyethyl methacrylate as the hydroxyl group-containing α,β-unsaturated monomer. It is possible to use each of the carboxyl group-containing α,β-unsaturated monomer and the hydroxyl group-containing α,β-unsaturated monomer singly or in the form of a mixture of a plurality of the compounds exemplified above.

To be more specific, it is desirable for the (meth)acrylic copolymer to be represented by general formula (I) given below, in which the atomic group generating the acid value is formed of a constituting unit based on the (meth)acrylic acid, and the atomic group generating the hydroxyl group value is formed of a constituting unit based on the (meth)acrylic acid hydroxyalkyl ester:

(I)

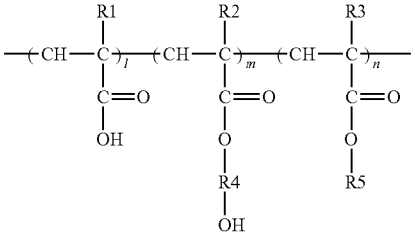

where R1, R2 and R3 independently denote a hydrogen atom or a methyl group, R4 denotes a linear or branched alkylene group having 2 to 4 carbon atoms, R5 denotes a linear or branched alkyl group having 1 to 18 carbon atoms, and each of l, m and n denotes the amount (% by weight) of the constituting unit based on each monomer, the values of l, m and n being chosen to permit the copolymer to exhibit an acid value of 10 to 100 mg KOH/g and a hydroxyl group value of 50 to 150 mg KOH/g. It is possible for each of the constituting units to be derived from a single monomer or a plurality of monomers.

Incidentally, the arrangement of the constituting units of the (meth)acrylic copolymer represented by general formula (I) given above, i.e., the arrangement of (meth)acrylic acid, (meth)acrylic acid hydroxyalkyl ester and (meth)acrylic acid alkyl ester, is not limited to that given in general formula (I). It is possible for these constituting units of the (meth)acrylic copolymer to be interchanged with each other.

It is more desirable for the (meth)acrylic copolymer to be represented by general formula (II) given below:

(II)

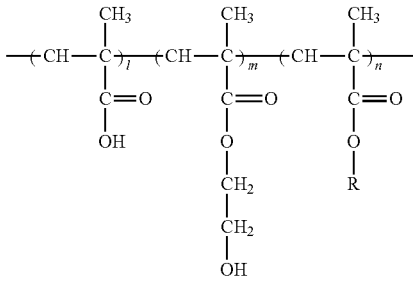

where R denotes an alkyl group, and each of l, m and n denotes the amount (% by weight) of the constituting unit based on each monomer, the values of l, m and n being chosen to permit the copolymer to exhibit an acid value of 10 to 100 mg KOH/g and a hydroxyl group value of 50 to 150 mg KOH/g. It is possible for the constituting unit based on the (meth)acrylic acid alkyl ester having R to be derived from a single monomer or a plurality of monomers.

Incidentally, the arrangement of the constituting units of the (meth)acrylic copolymer represented by general formula (II), i.e., the arrangement of (meth)acrylic acid, 2-hydroxyethyl(meth)acrylate and (meth)acrylic acid alkyl ester, is not limited to that given in general formula (II). It is possible for these constituting units of the (meth)acrylic copolymer represented by general formula (II) to be interchanged with each other.

It is desirable for the alkyl groups represented by R5 and R in general formulas (I) and (II) to have 1 to 18 carbon atoms, preferably 1 to 6 carbon atoms. To be more specific, each of the alkyl groups noted above includes, for example, methyl, ethyl, n-propyl, isopropyl, n-butyl, sec-butyl, isobutyl, n-amyl, isoamyl, sec-amyl, n-pentyl, n-hexyl, cyclohexyl, n-octyl, 2-ethyl hexyl, dodecyl, cetyl and stearyl groups, and it is desirable for each of the alkyl groups to be methyl, ethyl, n-propyl, isopropyl, n-butyl, sec-butyl, isobutyl, n-amyl, isoamyl, sec-amyl, n-pentyl, n-hexyl or cyclohexyl group. It should also be noted that the α,β-unsaturated monomer having the alkyl group noted above may be used singly or in the form of a mixture of a plurality of the α,β-unsaturated monomers.

It is desirable for the (meth)acrylic copolymer to have a weight average molecular weight falling between 40,000 and 1,000,000. If the weight average molecular weight of the (meth)acrylic copolymer is lower than 40,000, it is possible for the mechanical strength of the molded body of the (meth) acrylic copolymer to be lowered. On the other hand, if the weight average molecular weight of the (meth)acrylic copolymer exceeds 1,000,000, the fluidity of the (meth)

acrylic copolymer is lowered so as to impair the moldability of the (meth)acrylic copolymer.

The (meth)acrylic copolymer can be obtained by any of various polymerizing methods such as a solution polymerization method, a bulk polymerization method, an emulsion polymerization method and a suspension polymerization method, which are carried out by the ordinary polymerizing manner in the presence of a vinyl polymerization initiating agent. The vinyl polymerization initiating agent noted above includes azo compounds such as 2,2'-azo bis isobutyronitrile, 2,2'-azo bis-2-methyl butyronitrile, 2,2'-azo bis-2,4-dimethyl valeronitrile, and triphenyl methyl azo benzene and peroxides such as benzoyl peroxide, di-t-butyl peroxide, t-butyl peroxy benzoate, t-butyl peroxy isopropyl carbonate, t-butyl peroxy-2-ethyl hexanoate, t-butyl peroxy pivalate, and t-hexyl peroxy-2-ethyl hexanoate.

Figure 2:
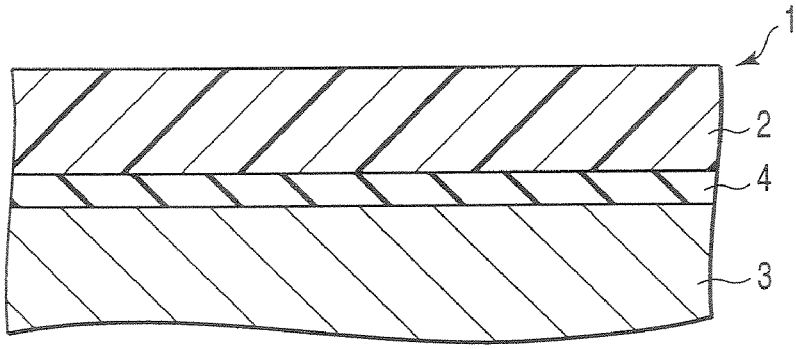
FIG. 2 is a cross-sectional view schematically showing the construction of a polishing cloth according to another embodiment of the present invention.

The polishing cloth of the embodiment is constructed as shown in FIG. 1 or FIG. 2. To be more specific, the polishing cloth 1 shown in FIG. 1 is constructed such that a molded body 2 obtained by molding the (meth)acrylic copolymer is fixed to a rotatable turntable 3. On the other hand, the polishing cloth 1 shown in FIG. 2 is constructed such that the molded body 2 obtained by molding the (meth)acrylic copolymer is fixed to the rotatable turntable 3 with a buffer material layer 4 such as a rubber layer interposed therebetween.

Particularly, it is desirable to use the polishing cloth shown in FIG. 2, which has a two-layer structure including the buffer material layer, because the polishing cloth noted above is excellent in its capability of following the undulation of the wafer so as to make it possible to achieve uniform polishing. The buffer material layer used in the embodiment is not particularly limited. However, it is desirable to use, for example, a polishing pad of the unwoven fabric type such as Suba-400 or Suba-800 manufactured by Rhodale Inc., rubber or an elastic foam as the buffer material layer 4.

The polishing cloth formed of the (meth)acrylic copolymer can be manufactured by, for example, a casting method in which the (meth)acrylic copolymer is cast on a base material formed of various materials such as a metal, a molding method such as a press molding method or an injection molding method. Particularly, since the (meth)acrylic copolymer is satisfactory in its moldability, the polishing cloth can be manufactured by the molding method such as a press molding method or an injection molding method.

It is possible to form a trench such as a lattice-shaped trench or a hole on the surface of the polishing cloth of the construction described above. The trench or the hole formed on the surface of the polishing cloth makes it possible to supply a fresh polishing slurry to the polishing region, to improve the fluidity of the polishing slurry, and to discharge the waste polishing slurry or the scrapings. The method of forming the trench or the hole is not particularly limited. For example, it is possible to form the trench or the hole by the cutting method using an NC rooter, by the method of collectively forming the trench by using a thermal press, by the press molding method or the injection molding method, in which a trench is formed simultaneously with the manufacture of the molded body of the (meth)acrylic copolymer, or by the method of forming a hole by using, for example, a drill.

An example of the polishing apparatus having the polishing cloth of the embodiment incorporated therein will now be described with reference to FIG. 3.

Figure 3:
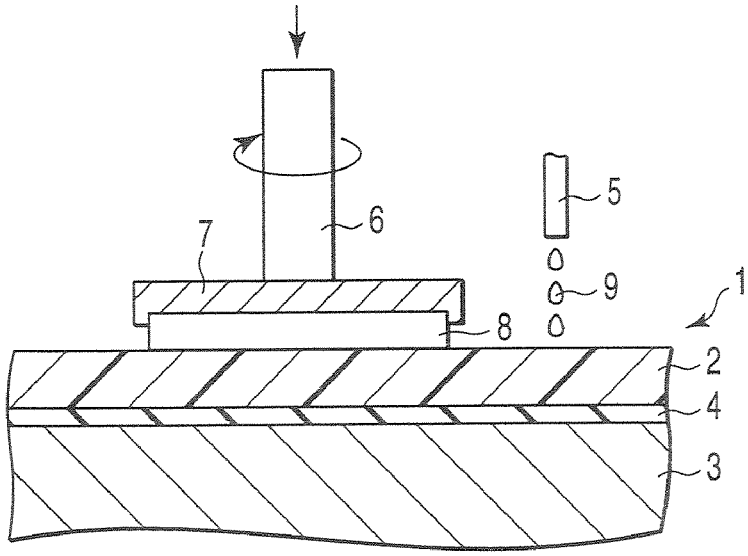
FIG. 3 schematically shows the construction of a polishing apparatus having the polishing cloth of the present invention incorporated therein.

As shown in FIG. 3, the polishing cloth 1 is constructed such that the molded body 2 prepared by, for example, the injection molding of the (meth)acrylic copolymer is fixed to the rotatable turntable 3 with the buffer material layer 4 such as a rubber layer interposed therebetween. A supply pipe 5 for supplying a polishing slurry containing abrasive grains, water and, as required, a surfactant and a dispersant onto the molded body 2 is arranged above the polishing cloth 1. A holder 7 equipped with a support shaft 6 on the upper surface is arranged to be rotatable above the polishing cloth 1. The holder 7 is also movable in the vertical direction.

It is possible to use at least one material selected from the group consisting of, for example, cerium oxide, manganese oxide, silica, alumina and zirconia as the abrasive grains contained in the polishing slurry.

The surfactant contained in the polishing cloth 1 includes, for example, nonionic surfactants such as polyethylene glycol alkyl phenyl ether, polyethylene glycol alkyl ether, polyethylene glycol fatty acid ester; amphoteric surfactants such as imidazolynium betaine; anionic surfactants such as sodium dodecyl sulfate; and cationic surfactants such as stearyl trimethyl ammonium chloride.

The polishing treatment using the polishing apparatus having the polishing cloth of the embodiment incorporated therein is carried out as follows.

In the first step, a target object 8 to be polished (e.g., a substrate) is held by the holder 7 such that the polishing surface of the target object 8 is allowed to face the molded body 2 of the (meth)acrylic copolymer included in the polishing cloth 1. Then, a desired load is applied from the support shaft 6 toward the polishing cloth 1 via the target object 8 to be polished while supplying a polishing slurry 8 containing abrasive grains and water onto the surface of the molded body 2 of the (meth)acrylic copolymer and while rotating the holder 7 and the turntable 3 of the polishing cloth 1 in the same direction. In this stage, the polishing surface of the target object 8 is polished mainly by the abrasive grains contained in the polishing slurry that is supplied into the clearance between the target object 8 and the polishing cloth 1.

The polishing cloth 1 according to the first embodiment of the present invention comprises the molded body of the (meth)acrylic copolymer having an acid value of 10 to 100 mg KOH/g an a hydroxyl group value of 50 to 150 mg KOH/g. The molded body noted above is scarcely dissolved in water and is slightly dissolved in the aqueous solution of potassium hydroxide so as to form a swollen layer on the surface that is in contact with water.

If the polishing slurry containing the abrasive grains and water is supplied onto the polishing cloth (i.e., the polishing cloth having fine irregularities formed thereon by the application of the initial dressing treatment) while allowing the target object 8 to be pushed against the polishing cloth 1 and while rotating the polishing cloth 1 and the target object 8 in the same direction, the abrasive grains contained in the polishing slurry are held in the concavities formed on the surface of the polishing cloth 1. The polishing surface of the target object 8 is polished mainly by the abrasive grains held in the concavities on the surface of the polishing cloth 1. Also, a swollen layer is formed on the surface of the polishing cloth 1. In this stage, the polishing cloth 1 receives a frictional force produced by the target object 8 and the abrasive grains, with the result that the swollen layer on the surface of the polishing cloth 1 is scraped off. When the swollen layer of the polishing cloth 1 is scraped off, the waste abrasive grains held on the surface of the polishing cloth 1 and the scrapings are also removed from the polishing cloth 1. As a result, the waste abrasive grains and the scrapings do not stay on the polishing cloth 1 so as to make it possible to supply fresh abrasive grains from the polishing slurry onto the polishing cloth 1. Such being the situation, it is possible for the abrasive grains to polish the target object to be polished with high polishing efficiency. It is also possible to stabilize the polishing rate. It follows that it is possible to polish the target object without applying a dressing treatment to the polishing cloth 1 for a long time, though it is certainly necessary to apply the initial dressing treatment to the polishing cloth 1. In other words, the target object can be polished while substantially omitting the dressing treatment.

Also, in the case of using the polishing cloth formed of the molded body of the (meth)acrylic copolymer containing (meth)acrylic acid units, (meth)acrylic acid hydroxy alkyl ester units, and (meth)acrylic acid alkyl ester units as the constituting units as shown in general formula (I) given previously, it is possible to permit the polishing cloth to polish the target object to be polished with high polishing efficiency. It is also possible to stabilize the polishing rate excellently.

Further, in the case of using the polishing cloth formed of the molded body of the (meth)acrylic copolymer containing (meth)acrylic acid units, 2-hydroxyethyl(meth)acrylate units, and (meth)acrylic acid alkyl ester units as the constituting units as shown in general formula (II) given previously, it is possible to permit the polishing cloth to polish the target object to be polished with high polishing efficiency. It is also possible to stabilize the polishing rate more excellently.

Further, in the case of using as the polishing cloth the molded body having, for example, a lattice-shaped trench formed thereon, it is possible to release easily the undesired abrasive grains and the polishing refuse from the polishing cloth in the polishing stage.

Still further, in the case where the polishing cloth 1 is constructed such that the molded body 2 formed of the (meth) acrylic copolymer is fixed to the turntable 3 with the buffer material layer 4 interposed therebetween as shown in FIG. 2, the buffering function is produced by the buffer material layer 4 in the polishing stage so as to make it possible to polish soft the target object to be polished.

Second Embodiment

A method of a second embodiment for manufacturing a semiconductor device having a shallow trench type element isolating (STI) region will now be described.

(First Step)

A buffer oxide film is formed first on the surface of a semiconductor substrate, followed by forming a mask material having a hole formed in the shape of the element isolating region. Then, the buffer oxide film and the semiconductor substrate positioned below the buffer oxide film are selectively removed by anisotropic etching such as reactive ion etching so as to form a trench on the semiconductor substrate. After formation of the trench, an insulating film is formed on the entire surface of the mask material including the trench in a thickness larger than the depth of the trench.

For forming the mask material, an insulating film such as a silicon nitride film (SiN film) is formed on the buffer oxide film, followed by forming a resist pattern on the silicon nitride film. Then, the silicon nitride film is selectively etched with the resist pattern used as a mask so as to obtain the mask material.

It is possible to use, for example, a $SiO_2$ film or a TEOS film as the insulating film formed on the mask material.

(Second Step)

A polishing slurry containing the abrasive grains is supplied onto the polishing cloth while allowing the insulating film formed on the semiconductor substrate to abut against the polishing cloth according to the first embodiment described previously and while rotating the polishing cloth and the semiconductor substrate in the same direction so as to apply a chemical mechanical polishing (CMP) treatment to the insulating film until the mask material is exposed to the outside, thereby burying the insulating film in the trench and in the hole formed through the buffer oxide film and the mask material. Then, the mask material and the buffer oxide film are removed so as to form a shallow trench type element isolating (STI) region in which the insulating material is buried in the trench. Incidentally, where the surface of the formed STI region protrudes from the surface of the semiconductor substrate, it is possible to apply an etching treatment to the insulating material so as to remove the buffer oxide film and to remove slightly that region of the insulating film which is positioned in the hole formed in the mask material before removal of the mask material and the buffer oxide film.

It is possible to use, for example, cerium oxide or silica for forming the abrasive grains.

As described above, according to the second embodiment, the insulating film can be polished in a simplified operating procedure by using the polishing cloth exhibiting a stable polishing performance and without employing the dressing treatment so as to make it possible to manufacture a semiconductor device having an STI region formed therein on a mass production basis.

Third Embodiment

A method of a third embodiment for manufacturing a semiconductor device including a flattened interlayer insulating film will now be described.

(First Step)

An irregular pattern, e.g., a gate electrode arranged on a gate insulating film, is formed on a semiconductor substrate having active elements such as diffusion layers formed therein. Then, an interlayer insulating film (first interlayer insulating film) is formed on the irregular pattern. In this stage, the irregular shape caused by the gate electrode is transferred onto the first interlayer insulating film so as to cause the first interlayer insulating film to have a surface having an irregular shape.

It is possible to use, for example, polycrystalline silicon (polysilicon), a metal having a high melting point such as W, Mo or Ti, or a silicide of the metal having a high melting point as the gate electrode material.

On the other hand, it is possible for the first interlayer insulating film to be formed of a silicon oxide film prepared by using a silane-based gas or a TEOS-based gas, or to be formed of an inorganic insulating film such as a boron-added glass (BPSG) film or a phosphorus-added glass (PSG) film.

(Second Step)

A polishing slurry containing the abrasive grains is supplied onto the polishing cloth while allowing the polishing cloth according to the first embodiment described previously to abut against the first interlayer insulating film formed on the semiconductor substrate and while rotating the polishing cloth and the semiconductor substrate in the same direction so as to apply a chemical mechanical polishing (CMP) treatment to the surface region of the first interlayer insulating film, thereby flattening the surface of the first interlayer insulating film.

It is possible for the abrasive grains to be formed of, for example, cerium oxide or silica as in the second embodiment described above.

As described above, according to the third embodiment, the first interlayer insulating film is polished by using the polishing cloth exhibiting a stable polishing performance in a simplified polishing procedure without employing the dressing treatment so as to flatten the surface of the interlayer insulating film. It follows that it is possible to manufacture on a mass production basis the semiconductor device that permits a high precision treatment and also permits fine processing in the subsequent pattern forming process.

Incidentally, the irregular pattern handled in the third embodiment is not limited to that caused by the gate electrode formed on the semiconductor substrate with the gate insulating film interposed therebetween. For example, it is also possible to apply the third embodiment to a wiring layer formed on the first interlayer insulating film positioned on the semiconductor substrate. In this case, if a second interlayer insulating film is formed on the first interlayer insulating film including the wiring layer, the irregular pattern caused by the wiring layer is transferred onto the surface of the second interlayer insulating film. It follows that the CMP treatment can be applied to the second interlayer insulating film so as to flatten the surface of the second interlayer insulating film.

Fourth Embodiment

A method of a fourth embodiment for manufacturing a semiconductor device equipped with a buried wiring layer will now be described.

(First Step)

An insulating film is formed on a semiconductor substrate. At least one burying member selected from the group consisting of a concave portion and an aperture portion is formed in the insulating film, followed by forming a conductive material film made of copper or a copper alloy on the entire surface including the burying member.

It is possible for the insulating film to be formed of a silicon oxide film prepared by using a silane-based gas or a TEOS-based gas, to be formed of an inorganic insulating film such as a boron-added glass (BPSG) film or a phosphorus-added glass (PSG) film, to be formed of a fluorine-containing insulating film having a low dielectric constant, or to be formed of a low-k film such as an organic film or a porous film. It is acceptable for the insulating film to be covered with a polish stopper film made of, for example, silicon nitride, carbon, alumina, boron nitride or diamond prior to the formation of the conductive material film.

It is possible to use, for example, a copper-based metal or tungsten as the conductive material. The copper-based metal used as the conductive material includes, for example, copper (Cu) and copper alloys (Cu alloys) such as Cu—Si alloy, Cu—Al alloy, Cu—Si—Al alloy and Cu—Ag alloy.

The conductive material film noted above can be formed by, for example, a sputter vapor deposition method, a vacuum vapor deposition method or a plating method.

Where a conductive material film made of the copper-based metal is formed on the insulating film including the burying member formed on the semiconductor substrate, it is acceptable to form a conductive barrier layer before formation of the conductive material film. In the case of forming the conductive barrier layer on the insulating film including the burying member, it is possible to form at least one buried conductive member selected from the group consisting of a wiring layer and a via fill in the burying member surrounded by the conductive barrier layer by applying a polishing treatment to the conductive material film, which is described herein later, after formation of the conductive material film. As a result, the copper-based metal constituting the conductive member is prevented from being diffused into the insulating film by the conductive barrier layer so as to make it possible to prevent the semiconductor substrate from being contaminated with copper.

The conductive barrier layer is of a single layer structure or a double layer structure formed of a conductive material selected from the group consisting of a TiN alloy, Ti, Nb, W, a WN alloy, a TaN alloy, a TaSiN alloy, Ta, Co, Zr, a ZrN alloy and a CuTa alloy. It is desirable for the conductive barrier layer to have a thickness falling between 15 and 50 nm.

(Second Step)

A polishing slurry containing the abrasive grains is supplied onto the surface of the polishing cloth while allowing the polishing cloth according to the first embodiment described previously to abut against the conductive material film formed on the semiconductor substrate and while rotating the polishing cloth and the semiconductor substrate in the same direction so as to apply a chemical mechanical polishing (CMP) treatment to the conductive material film until the surface of the insulating film is exposed to the outside. As a result, the conductive material is buried in the burying member so as to form a buried conductive member such as a buried wiring layer made of copper or a copper alloy.

Where a copper-based metal is used as the conductive material, the abrasive grains contained in the polishing slurry are formed of silica particles or alumina particles. On the other hand, where tungsten is used as the conductive material, silica particles or alumina particles are used as the abrasive grains.

Where tungsten is used as the conductive material, it is acceptable for the polishing slurry to further contain iron nitrate.

Where a copper-based metal is used as the conductive material, it is acceptable for the polishing slurry to contain a water-soluble organic acid (first organic acid), which reacts with copper contained in the polishing slurry so as to form a copper complex that is substantially insoluble in water and mechanically more brittle than copper, and an oxidizing agent.

The first organic acid noted above includes, for example, 2-quinoline carboxylic acid (quinaldic acid), 2-pyridine carboxylic acid, and 2,6-pyridine dicarboxylic acid.

It is desirable for the first organic acid to be contained in the polishing slurry in an amount of at least 0.1% by weight. If the amount of the first organic acid contained in the polishing slurry is smaller than 0.1% by weight, it is difficult to form sufficiently a copper complex that is mechanically more brittle than copper on the surface of copper or a copper alloy. As a result, it is difficult to increase sufficiently the polishing rate of copper or the copper alloy in the polishing stage. It is more desirable for the first organic acid to be contained in, for example, the polishing slurry in an amount falling within a range of between 0.3 and 1.2% by weight.

The oxidizing agent noted above serves to form a hydrate of copper when the polishing slurry or the polishing composition is brought into contact with copper or a copper alloy. It is possible to use, for example, hydrogen peroxide ($H_2O_2$) or sodium hypochlorite (NaClO) as the oxidizing agent.

It is desirable for the oxidizing agent to be contained in the polishing slurry in an amount that is at least 10 times as much as the weight of the first organic acid. If the amount of the oxidizing agent is smaller than the amount that is 10 times as much as the weight of the first organic acid, it is difficult to promote sufficiently the formation of the copper complex on the surface of copper or the copper alloy. It is more desirable for the amount of the oxidizing agent to be at least 30 times, furthermore desirably, at least 50 times, as much as the weight of the first organic acid.

It is acceptable for the polishing slurry for the copper-based metal to contain another organic acid (second organic acid) having at least one carboxyl group and at least one hydroxyl group.

The second organic acid serves to promote the formation of a copper hydrate performed by the oxidizing agent. The second organic acid used in the present invention includes, for example, lactic acid, tartaric acid, mandelic acid, and malic acid. It is possible to use these second organic acids singly or in the form of a mixture of a plurality of these second organic acids. Particularly, it is desirable to use lactic acid as the second organic acid.

It is desirable for the second organic acid to be contained in the polishing slurry in an amount of 20 to 250% by weight based on the amount of the first organic acid. If the amount of the second organic acid is smaller than 20% by weight, it is difficult for the oxidizing agent to produce sufficiently the function of promoting the formation of a copper hydrate. On the other hand, if the amount of the second organic agent exceeds 250% by weight, the conductive material film consisting of copper or a copper alloy tends to etched, resulting in failure to form a pattern. It is more desirable for the second organic acid to be contained in the polishing slurry in an amount of 40 to 200% by weight based on the amount of the first organic acid.

As described above, according to the fourth embodiment, the conductive material film can be polished in a simplified operation by using a polishing apparatus equipped with the polishing cloth exhibiting a stable polishing performance so as to make it possible to manufacture on a mass production basis a semiconductor device in which a conductive member such as a wiring layer having a desired thickness is formed in the burying member.

EXAMPLES

The present invention will now be described more in detail with reference to Examples of the present invention.

Synthetic Examples 1 and 2

The composition show in Table 1 given below excluding the solvent was charged in a five-mouth flask equipped with a thermometer, a reflux cooler, a dripping pipe, a nitrogen gas introducing pipe and a stirrer, and the composition in the flask was heated to 80° C. while stirring the composition and introducing a nitrogen gas into the flask. Then, a mixed liquid system consisting of the monomers for the copolymerization and the polymerization catalyst among the composition shown in Table 1 was dripped into the flask over 3 hours. After completion of the dripping, the reaction system was maintained at the temperature noted above for 6 hours so as to finish the polymerization reaction. As a result, obtained were two kinds of methacrylic copolymer solutions each containing 40% by weight of a solid component including the copolymers denoted by abbreviations in Table 1 given below.

TABLE 1

| | | | Synthetic Example 1 | Synthetic Example 2 |
|---|---|---|---|---|
| Mixing ratio (parts by weight) | Solvent | PGM | 298.2 | 298.2 |
| | | PMAc | 298.2 | 298.2 |
| | Monomers for copolymerization | MAA | 18.4 | 43.2 |
| | | HEMA | 92.8 | 92.8 |
| | | MMA | 100.8 | 70.0 |
| | | BMA | 188.0 | 194.0 |
| | Polymerization initiating agent | AIBN | 3.6 | 3.6 |

TABLE 1-continued

| | Synthetic Example 1 | Synthetic Example 2 |
|---|---|---|
| Weight average molecular weight | 57,000 | 42,000 |
| Acid value (mgKOH/g) | 30 | 70 |
| Hydroxyl group value (mgKOH/g) | 100 | 100 |
| Abbreviation of methacrylic copolymer | (A-1) | (A-2) |

The abbreviations of the raw materials shown in Table 1 denote the compounds given below:

PGM: propylene glycol monomethyl ether;
PMAc: propylene glycol monomethyl ether acetate;
MAA: methacrylic acid;
HEMA: 2-hydroxyethyl methacrylate;
MMA: methyl methacrylate;
BMA: n-butyl methacrylate;
AIBN: 2,2'-azo bis isobutyronitrile;

Comparative Synthetic Example 1

Charged in a five-mouth flask equipped with a thermometer, a reflux cooler, a dripping pipe, a nitrogen gas introducing pipe, and a stirrer were 298.2 parts by weight of propylene glycol monomethyl ether and 298.2 parts by weight of propylene glycol monomethyl ether acetate. Then, the charged materials were heated to 80° C. while stirring the charged materials and introducing a nitrogen gas into the flask. In the next step, a mixed liquid material consisting of 92.0 parts by weight of methacrylic acid, 92.8 parts by weight of 2-hydroxyethyl methacrylate, 12.0 parts by weight of methyl methacrylate, 203.2 parts by weight of n-butyl methacrylate, and 3.6 parts by weight of 2,2'-azo bis isobutyronitrile used as a polymerization initiating agent was dripped into the flask over 3 hours. After completion of the dripping, the temperature of the reaction system was maintained at the temperature noted above for 6 hours so as to finish the polymerization reaction. As a result, obtained was a methacrylic copolymer solution containing 40% by weight of a solid component including the methacrylic copolymer (R-1) having the acid value, the hydroxyl group value and the weight average molecular weight shown in Table 2.

Comparative Synthetic Example 2

Charged in a five-mouth flask equipped with a thermometer, a reflux cooler, a nitrogen gas introducing pipe, and a stirrer were 40.0 parts by weight of xylene, and 10.0 parts by weight of butyl acetate. Then, the mixture of the charged materials was heated to 134° C., and a mixed liquid system consisting of 15.0 parts by weight of methyl methacrylate, 85.0 parts by weight of n-butyl methacrylate, and 1.0 parts by weight of a polymerization catalyst "Perbutyl I" (trade name of t-butyl peroxy isopropyl carbonate manufactured by Japan Fat and Oil K.K.) was dripped into the flask over 3 hours. After completion of the dripping, the reaction system was maintained at the temperature noted above for 30 minutes. Then, a mixture consisting of 10.0 parts by weight of xylene and 1.0 parts by weight of Perbutyl I noted above was further dripped into the flask, and the resultant reaction system was kept stirred for 2 hours at the temperature noted above so as to finish the polymerization reaction.

Finally, the reaction mixture was diluted by adding 48.0 parts by weight of xylene to the reaction mixture so as to obtain a methacrylic copolymer solution containing 50% by weight of a solid component including the methacrylic copolymer (R-2) having the weight average molecular weight given in Table 2 and not having an acid value and a hydroxyl group value.

Synthetic Example 3

Charged in a four-mouth flask equipped with a thermometer, a reflux cooler, a nitrogen gas introducing pipe and a stirrer were 1,200.0 parts by weight of an ion exchange water, and 0.75 parts by weight of polyvinyl alcohol used as a dispersant. Then, the polyvinyl alcohol was dissolved in the ion exchange water by sufficiently stirring the ion exchange water. Further, a mixed solution consisting of 13.8 parts by weight of methacrylic acid, 69.6 parts by weight of 2-hydroxyethyl methacrylate, 75.6 parts by weight of methyl methacrylate, 141.0 parts by weight of n-butyl methacrylate, and 8.4 parts by weight of 2,2'-azobis-2,4-dimethyl valeronitrile used as a polymerization initiating agent was charged in the flask, and the resultant reaction system was kept stirred for 30 minutes at room temperature while introducing a nitrogen gas into the reaction system. Further, the reaction system was heated to 60° C. and the stirring was continued for 2 hours. Still further, the temperature of the reaction system was elevated to 80° C., and the reaction system was kept stirred for one hour so as to finish the polymerization reaction.

The resultant suspension was filtered and, then, the filtrate was dried so as to obtain a methacrylic copolymer (S-1) having an average particle diameter of 170 μm. The methacrylic copolymer (S-1) thus obtained was found to have an acid value, a hydroxyl group value and a weight average molecular weight as shown in Table 2 given below.

Incidentally, the methacrylic copolymers obtained in Synthetic Examples 1 to 3 and Comparative Synthetic Example 1 are represented by structural formula (A) given below. Table 2 also shows the amounts (l, m, n, p) of the structural units of structural formula (A), i.e., methacrylic acid (MAA), 2-hydroxyethyl methacrylate (HEMA), methyl methacrylate (MMA), and n-butyl methacrylate (BMA). Also, the composition of the methacrylic copolymer obtained in Comparative Synthetic Example 2 is given in Table 2 for the sake of convenience in terms of the amounts (n, p) of methyl methacrylate (MMA), and n-butyl methacrylate (BMA), which are constituting units of structural formula (A).

TABLE 2

| | Methacrylic copolymer | | | | |
|---|---|---|---|---|---|
| | A-1 (present invention) | A-2 (present invention) | R-1 (Reference Example) | R-2 (prior art 2) | S-1 (present invention) |
| MAA: l (wt %) | 4.6 | 10.8 | 23.0 | — | 4.4 |
| HEMA: m (wt %) | 23.2 | 23.2 | 23.2 | — | 22.5 |
| MMA: n (wt %) | 25.2 | 17.5 | 3.0 | 15.0 | 25.5 |
| BMA: p (wt %) | 47.0 | 48.5 | 50.8 | 85.0 | 47.6 |
| Acid value (mgKOH/g) | 30 | 70 | 150 | — | 28.4 |
| Hydroxyl group value (mgKOH/g) | 100 | 100 | 100 | — | 96.8 |

TABLE 2-continued

| | Methacrylic copolymer | | | | |
|---|---|---|---|---|---|
| | A-1 (present invention) | A-2 (present invention) | R-1 (Reference Example) | R-2 (prior art 2) | S-1 (present invention) |
| Weight average molecular weight | 57,000 | 42,000 | 84,000 | 45,000 | 361,000 |

(A)

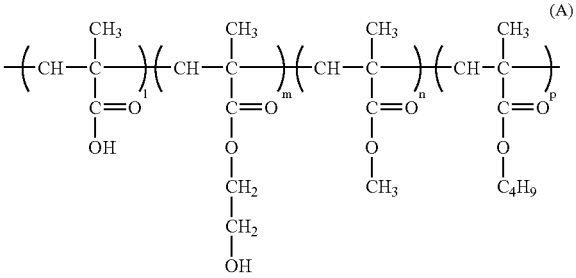

Example 1

Figure 4:
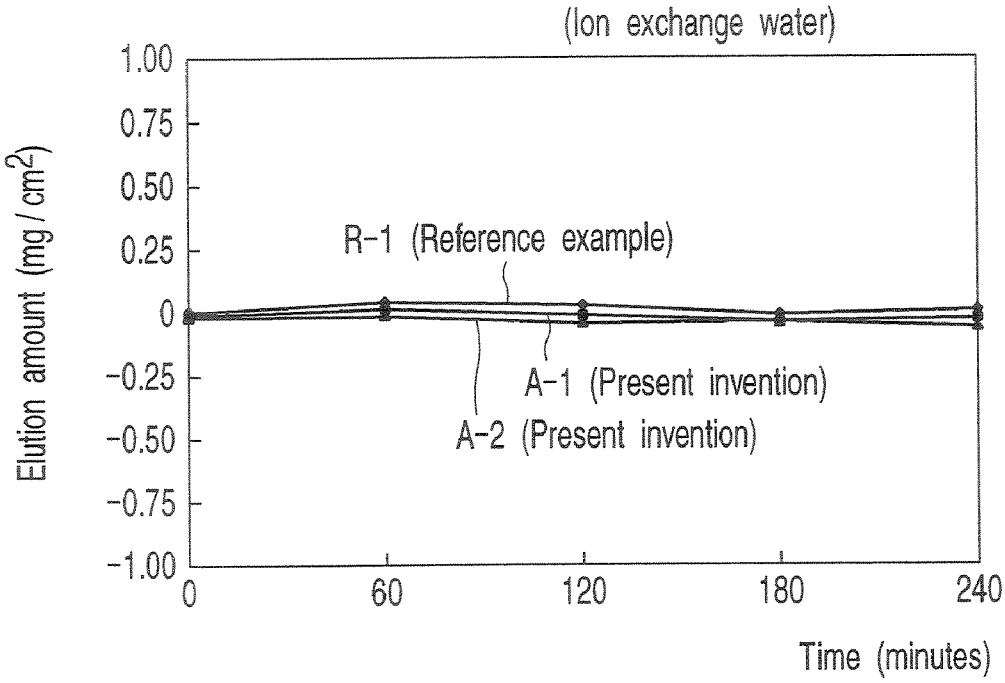
FIG. 4 is a graph showing the result of the evaluation in respect of the solubility of three kinds of (meth)acrylic copolymers for Example 1 of the present invention in an ion exchange water.

One surface of an aluminum plate excluding one edge side was coated with a methacrylic copolymer solution containing any of methacrylic copolymers A-1, A-2 and R-1 obtained in Synthetic Examples 1, 2 and Comparative Synthetic Example 1, respectively, followed by drying the coated solution so as to obtain the methacrylic copolymer film having a thickness of 100 μm. Then, the methacrylic copolymer film was dipped in an ion exchange water of 40° C. housed in a container by holding that portion of the Al plate on which the methacrylic copolymer film was not formed. Also, the ion exchange water was stirred by a stirring vane that was rotated at a rotating speed of 200 rpm. The Al plate having the methacrylic copolymer film formed thereon was kept dipped in the ion exchange water for 240 minutes so as to measure the change in weight of the methacrylic copolymer film 0 minute later, 60 minutes later, 120 minutes later, 180 minutes later, and 240 minutes later. In other words, measured were the weight of the Al plate immediately after the coating and drying of the methacrylic copolymer film and the weight (dry weight) of the Al plate the prescribed time after the dipping of the Al plate in the ion exchange water so as to obtain the change in weight of the methacrylic copolymer film on the basis of the difference in the measured value of the weight of the Al plate. FIG. 4 is a graph showing the experimental data. The negative value of the change in weight denotes that the methacrylic copolymer film eluted into the ion exchange water.

As is apparent from the experimental data given in FIG. 4, any of the methacrylic copolymer films A-1, A-2 obtained in Synthetic Examples 1 and 2 and the methacrylic copolymer film R-1 obtained in Comparative Synthetic Example 1 was found to be scarcely dissolved in the ion exchange water even if these methacrylic copolymer films were dipped in the ion exchange water for 240 minutes.

Example 2

The three kinds of methacrylic copolymer films as in Example 1 were formed on one-side surfaces excluding one-side edges of Al plates. Each of these methacrylic copolymer films was dipped in an aqueous solution of potassium hydroxide (KOH aqueous solution: pH=11), which was heated to 40°

Figure 5:
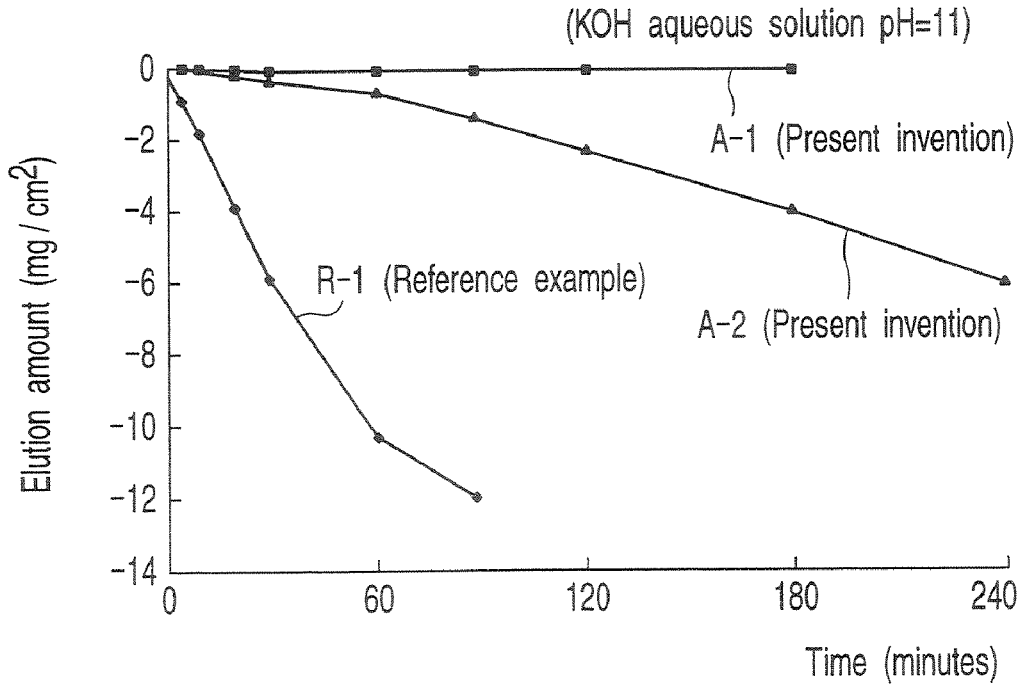
FIG. 5 is a graph showing the result of the evaluation in respect of the solubility of three kinds of (meth)acrylic copolymers for Example 2 of the present invention in an aqueous solution of potassium hydroxide.

C. and housed in a container, by holding that portion of the Al plate on which the methacrylic copolymer film was not formed. Also, the KOH aqueous solution was stirred by a stirring vane that was rotated at a rotating speed of 200 rpm. The aqueous solution of potassium hydroxide was used as a solution of the polishing slurry. The Al plate having the methacrylic copolymer film formed thereon was kept dipped in the KOH aqueous solution for 240 minutes so as to measure the change in weight of the methacrylic copolymer film 0 minutes later, 60 minutes later, 120 minutes later, 180 minutes later, and 240 minutes later. In other words, measured were the weight of the Al plate immediately after the coating and drying of the methacrylic copolymer film and the weight (dry weight) of the Al plate the prescribed time after the dipping of the Al plate in the KOH aqueous solution so as to obtain the change in weight of the methacrylic copolymer film on the basis of the difference in the measured value of the weight of the Al plate. FIG. 5 is a graph showing the experimental data. The negative value of the change in weight denotes that the methacrylic copolymer film eluted into the ion exchange water.

As is apparent from the experimental data given in FIG. 5, the methacrylic copolymer A-1 obtained in Synthetic Example 1, which exhibited an acid value of 30 mg KOH/g, was found to be scarcely dissolved in the KOH aqueous solution even if the methacrylic copolymer film was kept dipped in the KOH aqueous solution for 240 minutes. Also, the methacrylic copolymer A-2 obtained in Synthetic Example 2, which exhibited an acid value of 70 mg KOH/g, was found to be slightly dissolved in the KOH aqueous solution.

On the other hand, the methacrylic copolymer R-1 obtained in Comparative Synthetic Example 1, which exhibited an acid value exceeding 100 mg KOH/g, was found to be dissolved in the KOH aqueous solution in a considerably large amount before the dipping time of the methacrylic copolymer film in the KOH aqueous solution reached 60 minutes.

As is apparent from the experimental data obtained in Examples 1 and 2, the methacrylic copolymer of the present invention, which has an acid value falling between 10 and 100 mg KOH/g, is scarcely dissolved in the water (ion exchange water) contained in the polishing slurry and is slightly dissolved in the aqueous solution of potassium hydroxide used in the polishing slurry in which a fine powder, e.g., a silica fine powder, is dispersed. In other words, the methacrylic copolymer of the present invention is scraped off only when the methacrylic copolymer substantially receives a frictional force in the presence of the polishing slurry.

Example 3

A polishing slurry was prepared by dispersing in pure water 1% by weight of cerium oxide abrasive grains having an average grain diameter of 0.2 μm.

On the other hand, the polishing surface of Suba-400 (trade name of a soft polishing pad of an unwoven fabric type, which is manufactured by Rhodale Inc.) was coated with each of the methacrylic copolymer solutions A-1, A-2 obtained in Synthetic Examples 1, 2 and the methacrylic copolymer solution R-1 obtained in Comparative Synthetic Example 1, followed by drying the coated solution so as to form a polishing layer having a thickness of about 500 μm, thereby obtaining a polishing cloth of a two-layer type in which the polishing layer was formed on a buffer material layer. The polishing cloth thus obtained was incorporated in a polishing apparatus MA200 (trade name, manufactured by Musashi Kogyo K.K.), and the molded body of the polishing cloth was subjected to a dressing treatment by using a dressing apparatus equipped with a dressing tool.

In the next step, prepared was a silicon wafer sized at 20 mm square and having a silicon oxide film formed thereon, followed by allowing the holder of the polishing apparatus to hold the silicon wafer such that the silicon oxide film formed on the silicon wafer was positioned to face the polishing cloth. Under the particular state, the silicon wafer was pushed by the support shaft of the holder against the polishing cloth with a load of about 400 g/cm$^2$. Also, the polishing slurry was supplied from the supply pipe onto the surface of the polishing cloth at a rate of 10 mL/min while rotating the turntable supporting the polishing cloth and the holder supporting the silicon wafer in the same direction at the rotating speeds of 150 rpm and 112 rpm, respectively, so as to polish the silicon oxide film formed on the surface of the silicon wafer.

Also, a silicon oxide film formed on the surface of a silicon wafer was polished under the same conditions, except that the polishing cloth incorporated in the polishing apparatus was formed of IC1000 (trade name of a hard polyurethane foam manufactured by Inc.) and that the particular polishing cloth was subjected to a dressing treatment by using a dressing apparatus (Prior Art 1).

Figure 6:
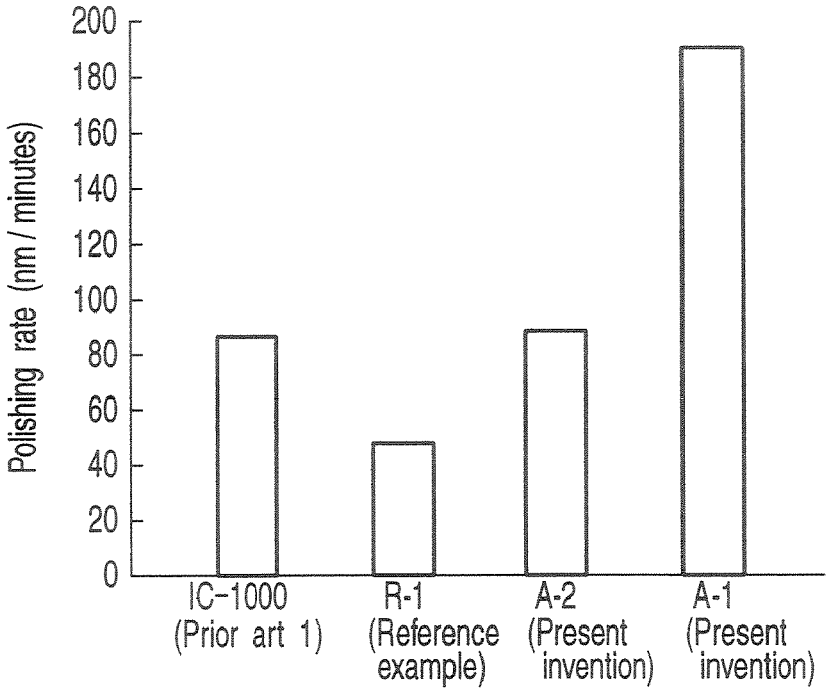
FIG. 6 is a graph showing the initial polishing rate of each of the polishing cloths for Example 3 of the present invention.

The silicon oxide film was polished by using a polishing apparatus having each of the four kinds of the polishing cloths incorporated therein so as to measure the polishing rate in the initial polishing stage of the silicon oxide film. FIG. 6 is a graph showing the experimental data.

As is apparent from the experimental data given in FIG. 6, each of the polishing cloths of the present invention comprising the molded bodies of methacrylic copolymers each having an acid value of 10 to 100 mg KOH/g (i.e., methacrylic copolymers A-1 and A-2 prepared in Synthetic Examples 1 and 2, respectively) exhibits a polishing rate higher than that of the polishing cloth for the Reference Example comprising a methacrylic copolymer having an acid value exceeding 100 mg KOH/g (i.e., methacrylic copolymer R-1 prepared in Comparative Synthetic Example 1). Particularly, the polishing cloth of the present invention comprising the molded boy of methacrylic copolymer having an acid value of 70 mg KOH/g (i.e., methacrylic copolymer A-2 prepared in Synthetic Example 2) exhibits a polishing rate substantially equal to that of the polishing cloth for Prior Art 1, which was formed of IC-1000. On the other hand, the polishing cloth of the present invention comprising the molded body of methacrylic copolymer having an acid value of 30 mg KOH/g (i.e., methacrylic copolymer A-1 prepared in Synthetic Example 1) exhibits a polishing rate markedly higher that of the polishing cloth for Prior Art 1, which was formed of IC-1000.

Example 4

Figure 7:
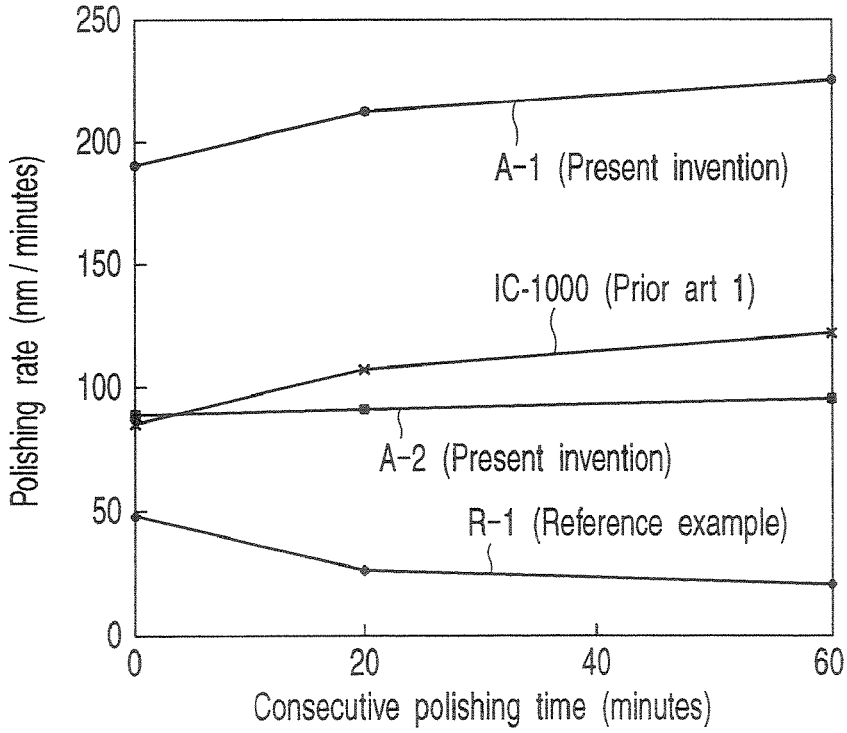
FIG. 7 is a graph showing the relationship between the polishing time and the polishing rate for each of the polishing cloths for Example 4 of the present invention.

The polishing time and the polishing rate of a silicon oxide film were measured by performing a polishing treatment of the silicon oxide film by using a polishing apparatus having each of the four kinds of the polishing cloths, which were prepared in Example 3, incorporated therein. FIG. 7 is a graph showing the experimental data.

As is apparent from the experimental data given in FIG. 7, the polishing cloth for Reference Example comprising the molded body of methacrylic copolymer having an acid value exceeding 100 mg KOH/g (i.e., methacrylic copolymer R-1 prepared in Comparative Synthetic Example 1) was found to be low in its initial polishing rate. In addition, the polishing rate was lowered with time. To be more specific, the polishing rate was lowered by about 60% based on the initial polishing rate in 60 minutes after initiation of the polishing treatment. In other words, the experimental data support that the polishing rate is changed in the case of using the polishing cloth for Reference Example.

The experimental data also support that the polishing rate is increased with increase in the polishing time when it comes to the polishing cloth for Prior Art 1, which was formed of a hard polyurethane foam (IC-1000). To be more specific, the polishing rate was increased by about 30% based on the initial polishing rate in 60 minutes after initiation of the polishing treatment. In other words, the experimental data support that the polishing rate is changed in the case of using the polishing cloth for Prior Art 1.

On the other hand, the polishing rate remains unchanged in 60 minutes after initiation of the polishing treatment in the case of using the polishing cloth of the present invention comprising the molded body of methacrylic copolymer having an acid value of 70 mg KOH/g (i.e., methacrylic copolymer A-2 prepared in Synthetic Example 2), supporting that the particular polishing cloth of the present invention exhibits a highly stable polishing rate.

Also, the polishing cloth of the present invention comprising the molded body of methacrylic copolymer having an acid value of 30 mg KOH/g (i.e., methacrylic copolymer A-1 prepared in Synthetic Example 1) exhibits a polishing rate markedly higher that of the polishing cloth for Prior Art 1, which was formed of IC-1000. In addition, although the polishing rate is slightly increased with increase in the polishing time, the polishing rate is increased in 60 minutes after initiation of the polishing treatment by only about 16% based on the initial polishing rate, supporting that the particular polishing cloth of the present invention exhibits a stable polishing rate.

Incidentally, a two-layer type polishing cloth having a polishing layer formed on a buffer material layer was prepared as Prior Art 2 by coating the polishing surface of Suba-400 with a methacrylic copolymer solution containing the methacrylic copolymer R-2 obtained in Comparative Synthetic Example 2, which did not have an acid value and a hydroxyl group value, followed by drying the coated solution so as to form a polishing layer having a thickness of 500 μm. The polishing cloth thus obtained was incorporated in a polishing apparatus similar to that used in Example 3, and the resultant polishing apparatus was subjected to a dressing treatment and, then, used for polishing a silicon wafer having a silicon oxide film formed thereon as in Example 3 so as to measure the polishing time and the polishing rate of the silicon oxide film. As a result, the polishing cloth for Prior Art 2 comprising the methacrylic copolymer R-2, which did not have an acid value and a hydroxyl group value, was found to exhibit a low initial polishing rate of 40 nm/m, though the polishing cloth exhibited a stable polishing rate.

Example 5

A polishing slurry was prepared by dispersing 1% by weight of cerium oxide abrasive grains having an average grain diameter of 0.2 μm in a pure water.

On the other hand, the methacrylic copolymer S-1 obtained in Synthetic Example 3 was subjected to an injection molding so as to obtain a disk-like molded body having a diameter of 60 cm and a thickness of 3 mm. The disk-like molded body thus obtained was attached to a surface of Suba-400 manufactured by Rhodale Inc. by using a double-sided tape, followed by forming a lattice-shaped trench having a width of 2 mm, a depth of 1 mm and a pitch width of 15 mm on the surface of the disk-like molded body so as to prepare a polishing pad of a two-layer structure. The polishing pad thus obtained was incorporated in the polishing apparatus shown in FIG. 3 and the molded body of the polishing cloth was subjected to a dressing treatment by using a dressing apparatus comprising a dressing tool.

Figure 8A:
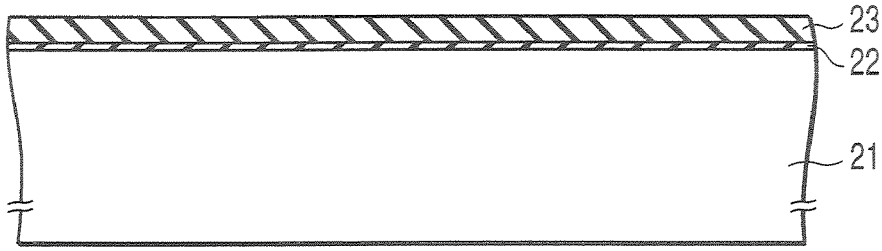
FIGS. 8A to 8D are cross-sectional views collectively showing the manufacturing process of a semiconductor device for Example 5 of the present invention.

In the next step, the surface of a silicon wafer 21 sized at 8 inches was oxidized so as to form a buffer oxide film 22 having a thickness of about 10 nm, as shown in FIG. 8A. Then, a silicon nitride film 23 was deposited in a thickness of 200 nm on the entire surface by the CVD method.

Figure 8B:
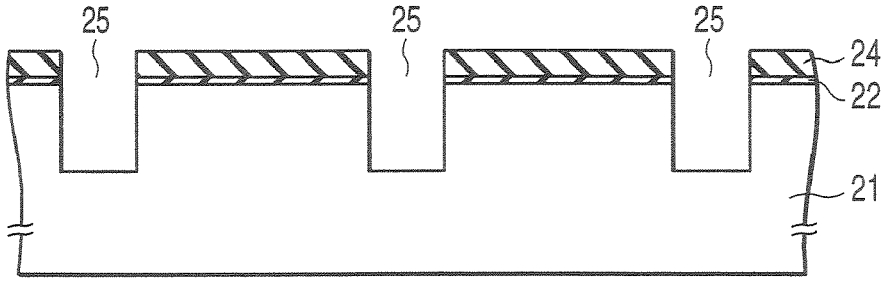
Figure 8C:
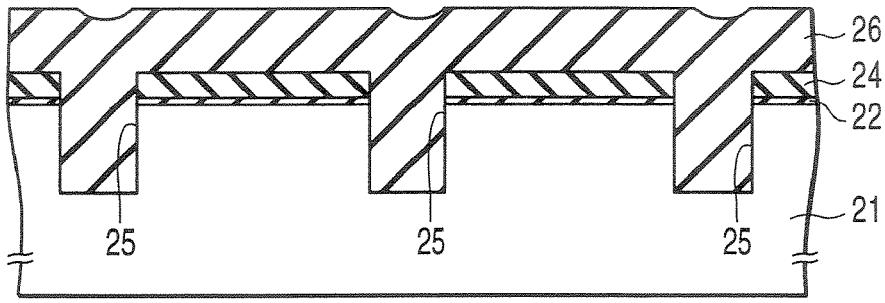

After deposition of the silicon nitride film 23, a resist pattern (not shown), which was selectively removed to form openings in the regions corresponding to the element isolating regions, was formed on the silicon nitride film 23. Then, the silicon nitride film was selectively etched with the resist pattern used as a mask so as to form a mask material 24, as shown in FIG. 8B. After the resist pattern was peeled off for the removal, those portion of the buffer oxide film 22 which were exposed to the outside and the silicon wafer 21 were selectively removed by an anisotropic etching such as a reactive ion etching so as to form trenches 25. Further, a $SiO_2$ film 26 was deposited by the CVD method on the entire surface of the mask material 24 including the trenches 25 in a thickness larger than the depth of the trench 25, as shown in FIG. 8C.

Figure 8D:
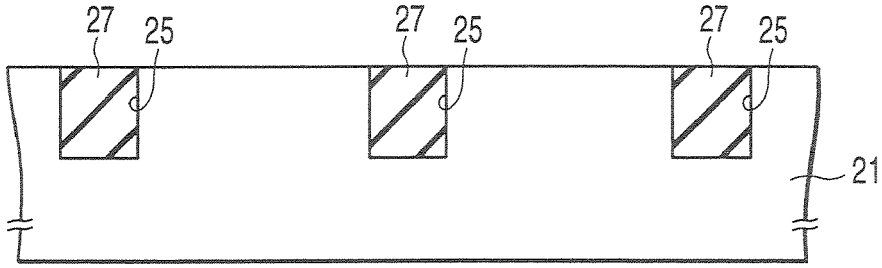

In the next step, the silicon wafer 21 having the $SiO_2$ film 26 deposited thereon was held by the holder 7 of the polishing apparatus shown in FIG. 3. Incidentally, the polishing cloth 1 comprising the molded body of the methacrylic copolymer S-1 referred to above was incorporated in the polishing apparatus shown in FIG. 3, and the silicon wafer 21 was held in a reversed fashion by the holder 7 of the polishing apparatus such that the $SiO_2$ film 26 formed on the silicon wafer 21 was allowed to face the polishing cloth 1. The silicon wafer 21 was pushed by the support shaft 6 of the polishing apparatus so as to impart a load of 400 gf/cm$^2$ to the polishing cloth 1. Also, the polishing slurry was supplied through the supply pipe 5 onto the surface of the polishing cloth 1 at a rate of 190 mL/min while rotating the turntable 3 of the polishing cloth 1 and the holder 7 in the same direction at the rotating speeds of 100 rpm and 107 rpm, respectively, thereby applying a CMP treatment to the $SiO_2$ film 26 until the surface of the mask material 24 excluding the trenches 25 was exposed to the outside. By this CMP treatment, the $SiO_2$ film 26 was left unremoved within the trenches 25 and within the holes extending through the buffer oxide film 22 and the mask material 24. Finally, the mask material 24 and the buffer oxide film 22 were removed so as to form a shallow trench type element isolating (STI) region 27 having the $SiO_2$ film buried in the trench 25, as shown in FIG. 8D.

The particular CMP treatment described above was consecutively applied to the silicon wafer 21, which corresponded to the polishing of 40 silicon wafers, with the result that it was possible to form stably the shallow trench type element isolating (STI) region 27 satisfactorily in any of all the silicon wafers 21.

Example 6

Figure 9A:
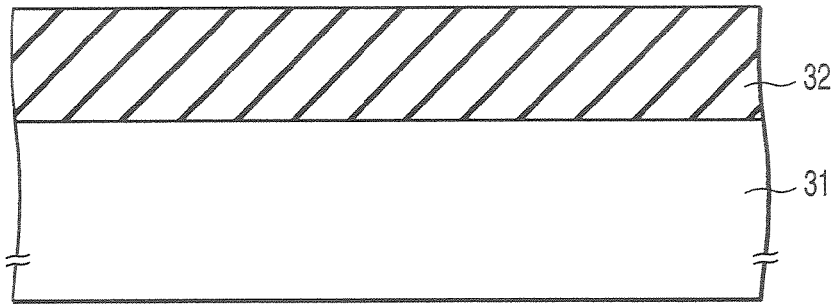
FIGS. 9A to 9C are cross-sectional views collectively showing the manufacturing process of a semiconductor device for Example 6 of the present invention.

As shown in FIG. 9A, a $SiO_2$ film (first interlayer insulating film) 32 having a thickness of, for example, 1000 nm was formed by a CVD method on a silicon wafer 31 having diffusion layers (not shown) such as a source region and a drain region formed therein.

Figure 9B:
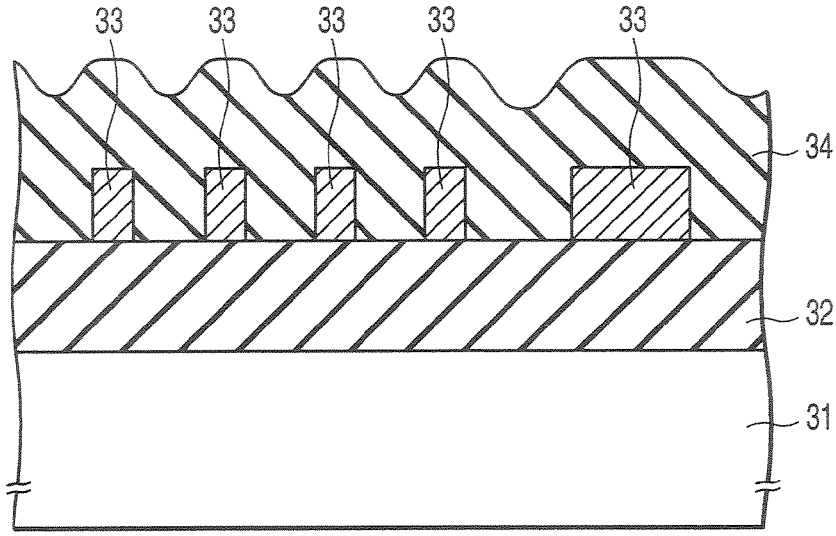

In the next step, an Al—Si alloy film was formed on the first interlayer insulating film 32, followed by forming a resist pattern (not shown) on the Al—Si alloy film, as shown in FIG. 9B. Then, anisotropic etching such as reactive ion etching was applied to the Al—Si alloy film with the resist pattern used as a mask so as to form a wiring layer 33. After formation of the wiring layer 33, a $SiO_2$ film (second interlayer insulating film) 34 was deposited by a CVD method on the entire surface of the first interlayer insulating film 32 including the wiring layer 33. In this step, the irregular surface shape caused by the formation of the wiring layer 33 was transferred onto the surface of the second interlayer insulating film 34 so as to have the irregular surface shape formed on the second interlayer insulating film 34.

Figure 9C:
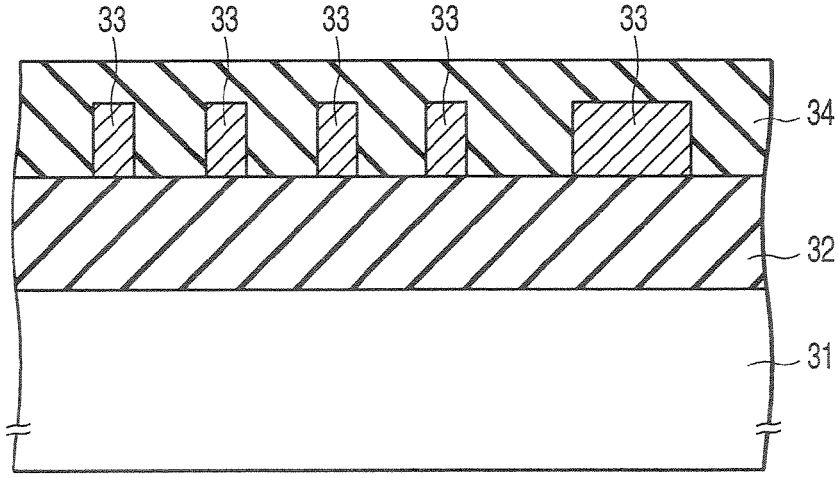

In the next step, the silicon wafer 31 was held by the holder 7 of the polishing apparatus shown in FIG. 3. Incidentally, the polishing cloth 1 comprising the molded body of the methacrylic copolymer S-1 referred to above was incorporated in the polishing apparatus shown in FIG. 3, and the silicon wafer 31 was held in a reversed fashion by the holder 7 of the polishing apparatus such that the second interlayer insulating film 34 formed on the silicon wafer 31 was allowed to face the polishing cloth 1. The silicon wafer 31 was pushed by the support shaft 6 of the polishing apparatus so as to impart a load of 400 gf/cm$^2$ to the polishing cloth 1. Also, the polishing slurry was supplied through the supply pipe 5 onto the surface of the polishing cloth 1 at a rate of 190 mL/min while rotating the turntable 3 of the polishing cloth 1 and the holder 7 in the same direction at the rotating speeds of 100 rpm and 107 rpm, respectively, thereby applying a CMP treatment to the surface of the second interlayer insulating film 34. By this CMP treatment, the surface of the second interlayer insulating film 34 was flattened, as shown in FIG. 9C.

The particular CMP treatment described above was consecutively applied to the silicon wafer 31, which corresponded to the polishing of 40 silicon wafers, with the result that it was possible to flatten stably the surface of the second interlayer insulating film 34 formed on any of all the silicon wafers 31.

Example 7

In the first step, prepared was a polishing slurry containing 3.6% by weight of colloidal silica, 1.1% by weight of colloidal alumina, 0.6% by weight of 2-quinoline carboxylic acid (quinaldic acid), 0.35% by weight of lactic acid, 1.8% by weight of dodecyl aluminum sulfate, 3.9% by weight of hydrogen peroxide, 0.5% by weight of hydroxyethyl cellulose, and the balance of water.

Figure 10A:
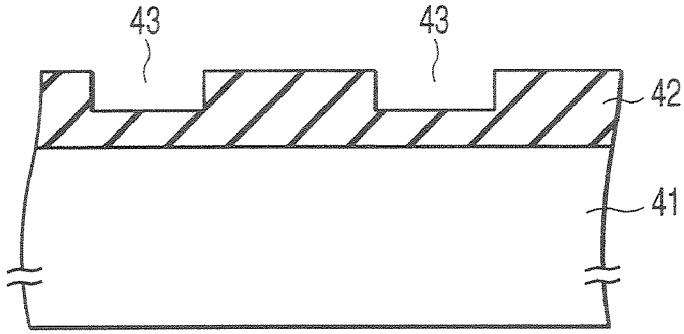
FIGS. 10A to 10C are cross-sectional views collectively showing the manufacturing process of a semiconductor device for Example 7 of the present invention.
Figure 10B:
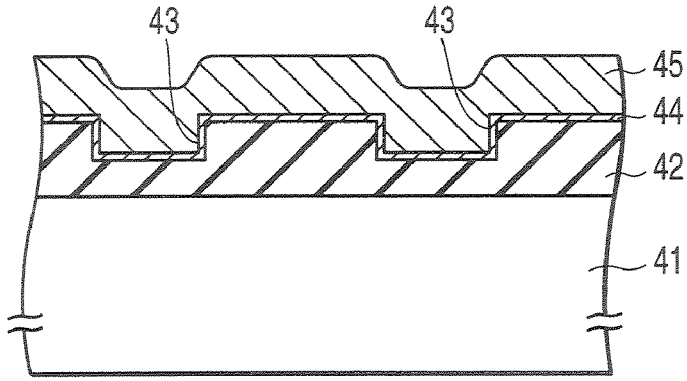

On the other hand, a $SiO_2$ film 42 having a thickness of, for example, 100 nm, which was used as an interlayer insulating film, was formed by a CVD method on the surface of a silicon wafer 41 having diffusion layers (not shown) such as a source region and drain region formed therein, as shown in FIG. 10A. Then, a plurality of trenches 43 each having a shape corresponding to the wiring layer and each having a width of 100 μm and a depth of 0.8 μm were formed by the photoetching technology in the $SiO_2$ film 42. After formation of the trenches 43, a barrier layer 44 made of TiN and having a thickness of 15 nm and a Cu film 45 having a thickness of 1.6 μm were successively formed in the order mentioned by a sputtering vapor deposition method on the $SiO_2$ film 42 including the trenches 43, as shown in FIG. 10B.

Figure 10C:
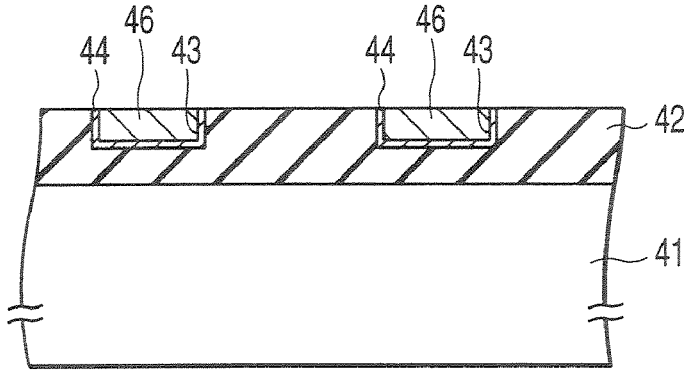

In the next step, the silicon wafer 41 having the Cu film 45 formed thereon was held by the holder 7 of the polishing apparatus shown in FIG. 3. Incidentally, the polishing cloth 1 comprising the molded body of the methacrylic copolymer S-1 referred to above was incorporated in the polishing apparatus shown in FIG. 3, and the silicon wafer 41 was held in a reversed fashion by the holder 7 of the polishing apparatus such that the Cu film 45 formed on the silicon wafer 41 was allowed to face the polishing cloth 1. The silicon wafer 41 was pushed by the support shaft 6 of the polishing apparatus so as to impart a load of 400 gf/cm$^2$ to the polishing cloth 1. Also, the polishing slurry was supplied through the supply pipe 5 onto the polishing cloth 1 at a rate of 50 mL/min while rotating the turntable 3 of the polishing cloth 1 and the holder 7 in the same direction at the rotating speeds of 100 rpm and 107 rpm, respectively, thereby applying a CMP treatment to the Cu film 45 and the barrier layer 44 until the surface of the $SiO_2$ film 42 excluding the trenches 43 was exposed to the outside. By this CMP treatment, formed was a buried Cu wiring layer 46 surrounded by the barrier layer 44 as shown in FIG. 10C, thereby manufacturing a desired semiconductor device.

The particular CMP treatment described above was consecutively applied to the silicon wafer 41, which corresponded to the polishing of 40 silicon wafers, with the result that it was possible to stably form a satisfactory buried Cu wiring layer 46 in any of all the silicon wafers 41.

As described above in detail, the present invention provides a polishing cloth capable of achieving a stable polishing performance over a long period of time without applying a dressing treatment to the polishing cloth.

Also, the present invention provides a method of manufacturing a semiconductor device, which permits stably forming a shallow trench type element isolating (STI) region in the semiconductor substrate.

Further, the present invention provides a method of manufacturing a semiconductor device, which permits stably forming an interlayer insulating film having a flattened surface on a semiconductor substrate.

Still further, the present invention provides a method of manufacturing a semiconductor device, which permits stably forming a high-precision conductive member such as a buried wiring layer in at least one burying member selected from the group consisting of a trench and an opening formed in the insulating film on the semiconductor substrate.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of manufacturing a semiconductor device, comprising:

forming a trench on a semiconductor substrate;

forming an insulating film on the semiconductor substrate having the trench formed thereon; and forming a buried element isolating region by supplying a polishing slurry containing abrasive grains onto the surface of a polishing cloth which comprises a molded body of a (meth)acrylic copolymer having an acid value of 10 to 100 mg KOH/g and a hydroxyl group value of 50 to 150 mg KOH/g, while rotating the semiconductor substrate under the state that the insulating film formed on the semiconductor substrate is allowed to abut against the polishing cloth, thereby polishing the upper portion of the insulating film such that the lower portion of the insulating film is left unremoved inside the trench, the unremoved lower portion of the insulating film forming the buried element isolating region, wherein the (meth)acrylic copolymer is represented by general formula (I) given below, in which the atomic group generating the acid value is formed of a constituting unit based on the (meth)acrylic acid, and the atomic group generating the hydroxyl group value is formed of a constituting unit based on the (meth)acrylic acid hydroxyalkyl ester:

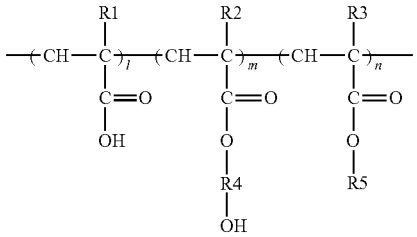

(I)

where R1, R2 and R3 independently denote a hydrogen atom or a methyl group, R4 denotes a linear or branched alkylene group having 2 to 4 carbon atoms, R5 denotes a linear or branched alkyl group having 1 to 18 carbon atoms, and each of l, m and n denotes the amount (% by weight) of the constituting unit based on each monomer, the values of l, m and n being chosen to permit the copolymer to exhibit an acid value of 10 to 100 mg KOH/g and a hydroxyl group value of 50 to 150 mg KOH/g.

2. The method of manufacturing a semiconductor device according to claim 1, wherein the molded body is made of the (meth)acrylic copolymer having a weight average molecular weight in the range of 40,000 to 1,000,000.

3. The method of manufacturing a semiconductor device according to claim 1, wherein the molded body is fixed directly to a turntable that can be rotated.

4. The method of manufacturing a semiconductor device according to claim 1, wherein the molded body is fixed to a turntable that can be rotated with a buffer material layer interposed between the molded body and the turntable.

5. The method of manufacturing a semiconductor device according to claim 4, wherein the buffer material layer is selected from the group consisting of an unwoven fabric type polishing pad, a rubber layer and an elastic foamed layer.

6. The method of manufacturing a semiconductor device according to claim 1, wherein the abrasive grains are grains of at least one oxide selected from the group consisting of cerium oxide and silica.

7. A method of manufacturing a semiconductor device, comprising:

forming an interlayer insulating film on an irregular pattern on a semiconductor substrate; and supplying a polishing slurry containing abrasive grains onto the surface of a polishing cloth which comprises a molded body of a (meth)acrylic copolymer having an acid value of 10 to 100 mg KOH/g and a hydroxyl group value of 50 to 150 mg KOH/g, while allowing the interlayer insulating film formed on the semiconductor substrate to abut against the polishing cloth, thereby polishing the interlayer insulating film, wherein the (meth)acrylic copolymer is represented by general formula (I) given below, in which the atomic group generating the acid value is formed of a constituting unit based on the (meth)acrylic acid, and the atomic group generating the hydroxyl group value is formed of a constituting unit based on the (meth)acrylic acid hydroxyalkyl ester:

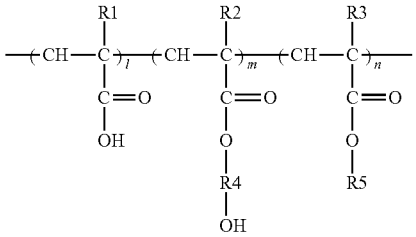

(I)

where R1, R2 and R3 independently denote a hydrogen atom or a methyl group, R4 denotes a linear or branched alkylene group having 2 to 4 carbon atoms, R5 denotes a linear or branched alkyl group having 1 to 18 carbon atoms, and each of l, m and n denotes the amount (% by weight) of the constituting unit based on each monomer, the values of l, m and n being chosen to permit the copolymer to exhibit an acid value of 10 to 100 mg KOH/g and a hydroxyl group value of 50 to 150 mg KOH/g.

8. The method of manufacturing a semiconductor device according to claim 7, wherein the molded body is made of the (meth)acrylic copolymer having a weight average molecular weight in the range of 40,000 to 1,000,000.

9. The method of manufacturing a semiconductor device according to claim 7, wherein the molded body is fixed directly to a turntable that can be rotated.

10. The method of manufacturing a semiconductor device according to claim 7, wherein the molded body is fixed to a turntable that can be rotated with a buffer material layer interposed between the molded body and the turntable.

11. The method of manufacturing a semiconductor device according to claim 10, wherein the buffer material layer is selected from the group consisting of an unwoven fabric type polishing pad, a rubber layer and an elastic foamed layer.

12. The method of manufacturing a semiconductor device according to claim 7, wherein the abrasive grains are grains of at least one oxide selected from the group consisting of cerium oxide and silica.

13. A method of manufacturing a semiconductor device, comprising:

forming an insulating film on a semiconductor substrate;

forming at least one burying member selected from the group consisting of a trench corresponding to the shape of a wiring layer and an aperture portion corresponding to the shape of a via fill in the insulating film;

forming a conductive material film on the insulating film including the inner surface of the burying member; and supplying a polishing slurry containing abrasive grains onto the surface of a polishing cloth which comprises a molded body of a (meth)acrylic copolymer having an acid value of 10 to 100 mg KOH/g and a hydroxyl group value of 50 to 150 mg KOH/g, while rotating the semiconductor substrate under the state that the conductive material film is allowed to abut against the polishing cloth so as to polish the upper portion of the conductive material film such that the lower portion of the conductive material film is left unremoved inside the burying member, thereby forming at least one conductive member selected from the group consisting of a wiring layer and a via fill, wherein the (meth)acrylic copolymer is represented by general formula (I) given below, in which the atomic group generating the acid value is formed of a constituting unit based on the (meth)acrylic acid, and the atomic group generating the hydroxyl group value is formed of a constituting unit based on the (meth)acrylic acid hydroxyalkyl ester:

(I)

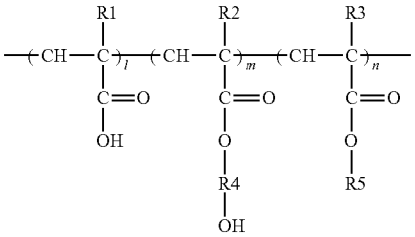

where R1, R2 and R3 independently denote a hydrogen atom or a methyl group, R4 denotes a linear or branched alkylene group having 2 to 4 carbon atoms, R5 denotes a linear or branched alkyl group having 1 to 18 carbon atoms, and each of l, m and n denotes the amount (% by weight) of the constituting unit based on each monomer, the values of l, m and n being chosen to permit the copolymer to exhibit an acid value of 10 to 100 mg KOH/9 and a hydroxyl group value of 50 to 150 mg KOH/g.

14. The method of manufacturing a semiconductor device according to claim 13, wherein the molded body is made of the (meth)acrylic copolymer having a weight average molecular weight in the range of 40,000 to 1,000,000.

15. The method of manufacturing a semiconductor device according to claim 13, wherein the molded body is fixed directly to a turntable that can be rotated.

16. The method of manufacturing a semiconductor device according to claim 13, wherein the molded body is fixed to a turntable that can be rotated with a buffer material layer interposed between the molded body and the turntable.

17. The method of manufacturing a semiconductor device according to claim 16, wherein the buffer material layer is selected from the group consisting of an unwoven fabric type polishing pad, a rubber layer and an elastic foamed layer.

18. The method of manufacturing a semiconductor device according to claim 13, wherein the conductive material is selected from the group consisting of copper and a copper alloy.

19. The method of manufacturing a semiconductor device according to claim 18, wherein a barrier layer is formed on the insulating film including the inner surface of the burying member prior to formation of the conductive material layer.

20. The method of manufacturing a semiconductor device according to claim 13, wherein the abrasive grains are grains of at least one oxide selected from the group consisting of cerium oxide and silica.

21. A method of manufacturing a semiconductor device, comprising:

forming a trench on a semiconductor substrate;

forming an insulating film on the semiconductor substrate having the trench formed thereon; and forming a buried element isolating region by supplying a polishing slurry containing abrasive grains onto the surface of a polishing cloth which comprises a molded body of a (meth)acrylic copolymer having an acid value of 10 to 100 mg KOH/g and a hydroxyl group value of 50 to 150 mg KOH/g, while rotating the semiconductor substrate under the state that the insulating film formed on the semiconductor substrate is allowed to abut against the polishing cloth, thereby polishing the upper portion of the insulating film such that the lower portion of the insulating film is left unremoved inside the trench, the unremoved lower portion of the insulating film forming the buried element isolating region, wherein the (meth)acrylic copolymer is represented by general formula (II) given below, in which the atomic group generating the acid value is formed of a constituting unit based on the (meth)acrylic acid, and the atomic group generating the hydroxyl group value is formed of a constituting unit based on 2-hydroxyethyl (meth)acrylate:

(II)

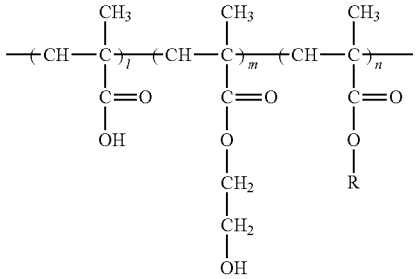

where R denotes an alkyl group, and each of l, m and n denotes the amount (% by weight) of the constituting unit based on each monomer, the values of l, m and n being chosen to permit the copolymer to exhibit an acid value of 10 to 100 mg KOH/g and a hydroxyl group value of 50 to 150 mg KOH/g, it being possible for the constituting unit based on the (meth)acrylic acid alkyl ester having R to be derived from a single monomer or a plurality of monomers.

22. A method of manufacturing a semiconductor device, comprising:

forming an interlayer insulating film on an irregular pattern on a semiconductor substrate; and supplying a polishing slurry containing abrasive grains onto the surface of a polishing cloth which comprises a molded body of a (meth)acrylic copolymer having an acid value of 10 to 100 mg KOH/g and a hydroxyl group value of 50 to 150 mg KOH/g, while allowing the interlayer insulating film formed on the semiconductor substrate to abut against the polishing cloth, thereby polishing the interlayer insulating film, wherein the (meth)acrylic copolymer is represented by general formula (II) given below, in which the atomic group generating the acid value is formed of a constituting unit based on the (meth)acrylic acid, and the atomic group generating the hydroxyl group value is formed of a constituting unit based on 2-hydroxyethyl (meth)acrylate:

(II)

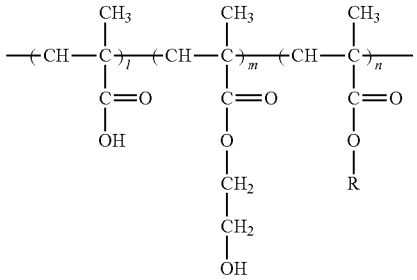

where R denotes an alkyl group, and each of l, m and n denotes the amount (% by weight) of the constituting unit based on each monomer, the values of l, m and n being chosen to permit the copolymer to exhibit an acid value of 10 to 100 mg KOH/g and a hydroxyl group value of 50 to 150 mg KOH/g, it being possible for the constituting unit based on the (meth)acrylic acid alkyl ester having R to be derived from a single monomer or a plurality of monomers.

23. A method of manufacturing a semiconductor device, comprising:

forming an insulating film on a semiconductor substrate;

forming at least one burying member selected from the group consisting of a trench corresponding to the shape of a wiring layer and an aperture portion corresponding to the shape of a via fill in the insulating film;

forming a conductive material film on the insulating film including the inner surface of the burying member; and supplying a polishing slurry containing abrasive grains onto the surface of a polishing cloth which comprises a molded body of a (meth)acrylic copolymer having an acid value of 10 to 100 mg KOH/g and a hydroxyl group value of 50 to 150 mg KOH/g, while rotating the semiconductor substrate under the state that the conductive material film is allowed to abut against the polishing cloth so as to polish the upper portion of the conductive material film such that the lower portion of the conductive material film is left unremoved inside the burying member, thereby forming at least one conductive member selected from the group consisting of a wiring layer and a via fill, wherein the (meth)acrylic copolymer is represented by general formula (II) given below, in which the atomic group generating the acid value is formed of a constituting unit based on the (meth)acrylic acid, and the atomic group generating the hydroxyl group value is formed of a constituting unit based on 2-hydroxyethyl (meth)acrylate:

(II)

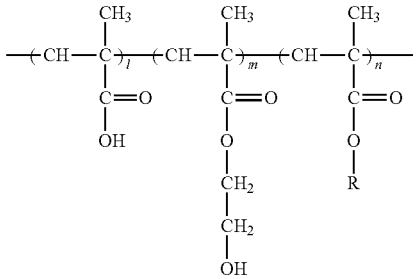

where R denotes an alkyl group, and each of l, m and n denotes the amount (% by weight) of the constituting unit based on each monomer, the values of l, m and n being chosen to permit the copolymer to exhibit an acid value of 10 to 100 mg KOH/g and a hydroxyl group value of 50 to 150 mg KOH/g, it being possible for the constituting unit based on the (meth)acrylic acid alkyl ester having R to be derived from a single monomer or a plurality of monomers.

* * * * *